US007094962B2

(12) United States Patent
Kayama

(10) Patent No.: US 7,094,962 B2
(45) Date of Patent: Aug. 22, 2006

(54) SCORE DATA DISPLAY/EDITING APPARATUS AND PROGRAM

(75) Inventor: Hiraku Kayama, Hamamatsu (JP)

(73) Assignee: Yamaha Corporation, (JP)

( * ) Notice: Subject to any disclaimer, the term of this patent is extended or adjusted under 35 U.S.C. 154(b) by 169 days.

(21) Appl. No.: 10/787,044

(22) Filed: Feb. 25, 2004

(65) Prior Publication Data

US 2004/0177745 A1 Sep. 16, 2004

(30) Foreign Application Priority Data

Feb. 27, 2003 (JP) ..... 2003-052058

(51) Int. Cl.
*G10H 7/00* (2006.01)

(52) U.S. Cl. ..... 84/609; 84/645; 84/477 R; 84/462

(58) Field of Classification Search ..... 84/609, 84/634, 462, 477 R, 610, 464 R, 485 R
See application file for complete search history.

(56) References Cited

U.S. PATENT DOCUMENTS

| | | | | |
|---|---|---|---|---|
| 5,085,116 | A * | 2/1992 | Nakata et al. | 84/609 |
| 6,252,152 | B1 * | 6/2001 | Aoki et al. | 84/609 |
| 6,689,946 | B1 | 2/2004 | Funaki | |
| 2004/0094017 | A1 * | 5/2004 | Suzuki et al. | 84/609 |

FOREIGN PATENT DOCUMENTS

| | | |
|---|---|---|
| JP | 09-006346 | 1/1997 |
| JP | 2001-147691 | 5/2001 |
| JP | 2001-306067 A | 11/2001 |
| JP | 2002-202790 A | 7/2002 |

OTHER PUBLICATIONS

Joe Mizuno et al: "Musical Instrument Digital Interface Sequencer Software: Euphony," Fujitsu Scientific & Technical Journal, Oct. 1990, vol. 26, No. 3, pp. 207-213.

Jim Aiken: "How Can Music Be Edited In A Sequencer?" Keyboard, Miller Freeman Publications, Oct. 1992, vol. 18, No. 10, pp. 116-118.

Office Action dated Mar. 22, 2006 from corresponding Japanese application No. P2003-052058.

* cited by examiner

*Primary Examiner*—Jeffrey Donels
*Assistant Examiner*—Christina Russell
(74) *Attorney, Agent, or Firm*—Rossi, Kimms & McDowell, LLP

(57) ABSTRACT

For a plurality of types of additional attribute data included in note data, a selection section selects one or more of the plurality of types of additional attribute data. For a plurality of the note data, a display section displays pictorial figures or the like representative of the contents of the additional attribute data of the types selected by the selection section, in proximity to pictorial figures or the like representative of pitches and sounding periods of the note data. The display section also displays pictorial figures or the like indicative of the contents of the additional attribute data, at positions and in sizes corresponding to periods or timing when musical expressions or the like indicated by the additional attribute data are to be applied.

11 Claims, 9 Drawing Sheets

| | |
|---|---|
| TIME | 4/4 |
| TEMPO | 120 |
| RESOLUTION | 480 |

PART 3

PART 2

PART 1

| NO. | PITCH | SOUNDING PERIOD START TIME | SOUNDING PERIOD END TIME | PHONETIC SYMBOL | NOTE VELOCITY | ACCENT INTENSITY | LEGATO INTENSITY | VIBRATO INTENSITY | VIBRATO PERIOD START TIME | VIBRATO PERIOD LENGTH |
|---|---|---|---|---|---|---|---|---|---|---|
| N1001 | F3 | 0001:01:020 | 0001:01:475 | sa | 95 | H | | | | |
| N1002 | G3 | 0001:02:010 | 0001:02:470 | ku | 85 | | M | | | |
| N1003 | A3 | 0001:03:000 | 0001:04:424 | ra | 90 | | | L | 120 | 480 |
| N1004 | F3 | 0002:01:015 | 0002:01:473 | sa | 93 | M | | | | |
| N1005 | G3 | 0002:02:005 | 0002:02:465 | ku | 76 | | L | | | |
| N1006 | A3 | 0002:02:478 | 0002:04:410 | ra | 82 | | | M | 150 | 360 |
| ⋮ | ⋮ | ⋮ | ⋮ | ⋮ | ⋮ | ⋮ | ⋮ | ⋮ | ⋮ | ⋮ |

FIG. 3

| SEGMENT NO. | SEGMENT NAME | SEGMENT TIME LENGTH | VOWEL SEGMENT | SOUNDING PERIOD START TIME | ADJUSTED SEGMENT TIME LENGTH |
|---|---|---|---|---|---|
| 1 | #s | 015 | | 0000:04:440 | 015 |
| 2 | s | 013 | | 0000:04:455 | 013 |
| 3 | s-a | 032 | | 0000:04:468 | 032 |
| 4 | a | 093 | Yes | 0001:01:020 | 345 |
| 5 | a-k | 028 | | 0001:01:365 | 028 |
| 6 | k | 010 | | 0001:01:393 | 010 |
| 7 | k-u | 087 | | 0001:01:403 | 087 |
| 8 | u | 105 | Yes | 0001:02:010 | 369 |
| 9 | u-r | 035 | | 0001:02:379 | 035 |
| 10 | r | 018 | | 0001:02:414 | 018 |
| 11 | r-a | 048 | | 0001:02:432 | 048 |
| 12 | a | 093 | Yes | 0001:03:000 | 904 |
| 13 | a# | 025 | | 0001:04:424 | 025 |
| ⋮ | ⋮ | ⋮ | ⋮ | ⋮ | ⋮ |

FIG. 5

PART 3

PART 2

PART 1

PART DISPLAY :Yes

| DATA NAME | DISPLAY | EDITING |
|---|---|---|
| PITCH | — | No |
| SOUNDING PERIOD | — | No |
| PHONETIC SYMBOL | No | No |
| NOTE VELOCITY | No | No |
| ACCENT | No | No |
| LEGATO | No | No |
| VIBRATO | No | No |

SCORE DATA DISPLAY/EDITING APPARATUS AND PROGRAM

BACKGROUND OF THE INVENTION

The present invention relates to apparatus and programs for displaying and editing score data to be used for automatic performances.

There have been known techniques for causing an automatic performance apparatus to execute an automatic performance of a music piece using a score data set that includes a plurality of note data indicative of pitches, sounding periods of musical sounds included in the music piece. Also, score data displaying/editing apparatus have been known which display and edit a score data set to be used for an automatic performance.

Among various known score data displays employed in the score data displaying/editing apparatus is one called a "piano roll display". On the piano roll display screen, bar-shaped pictorial figures, corresponding to sounds represented by individual note data, are placed on a coordinate plane having an axis representative of sound pitches and an axis representative of the passage of time. User can know pitches and sounding periods of the individual sounds, on the basis of positions, in the pitch axis direction, of the corresponding bar-shaped pictorial figures and positions and lengths, in the time axis direction, of the same pictorial figures. The note data included in the score data set each include various types of data in addition to the data representative of the pitch and sounding period, and the score data displaying/editing apparatus can not only display but also edit these various types of data included in the note data.

In Japanese Patent Application Laid-open Publication No. 2001-306067, for example, there is disclosed an apparatus which is constructed to not only display pitches and sounding periods of note data by a piano roll display but also display and edit lyric (words of a song) data to thereby associate the edited lyric data with sounds represented by the note data. Further, from Japanese Patent Application Laid-open Publication No. 2002-202790 etc., there has been known a technique which causes a singing synthesis apparatus to automatically sing a song using a singing score data set including lyric-related data.

When a user wants to edit given data included in a score data set, there is a need for the user to ascertain correspondency between the given data and other data included in the same note data as the given data. Further, in this case, the user has to ascertain correspondency between the given data to be edited and data included in note data that precede and succeed the note data including the given data.

However, generally, if contents of a plurality of types of data are simultaneously displayed for a plurality of note data in the conventionally-known score data displaying/editing apparatus, pictorial figures representative of pitches and sounding periods of note data etc. and pictorial figures representative of other information, such as vibrato information, than the pitches and sounding periods are displayed apart (i.e., at a relatively great distance) from each other. Thus, it was difficult for the user to intuitively grasp what kinds of information are attached to the individual notes.

Some of the conventionally-known score data displaying/editing apparatus have a function of displaying a plurality of types of data, included in note data, near pictorial figures representative of pitches and sounding periods of the note data. However, in such score data displaying/editing apparatus, the plurality of types of data are displayed simultaneously only for one note data at a time, not for a plurality of note data. Therefore, it was difficult for the user to readily grasp, from the display, arranged states, on the time axis, of other information than pitches and sounding periods, e.g. with a view to determining a particular type of expression to be imparted to a note or notes residing at a particular location within a phrase of a certain length.

Further, for some of the data included in the note data, relative positional relationships would become important between a time period when a process instructed by the data should be carried out or an effect instructed by the data should appear and a sounding period designated by the note data. Typical example of such data is one instructing a vibrato for imparting a tone with a vibrating expression. In sounding a certain voice, which position in the sounding period the vibrato should start at is an important factor that governs an impression of the performance given to one or more human listeners. But, the conventionally-known score data displaying/editing apparatus was not constructed to perform any display that allows the user to grasp, in relation to the note sounding period, at which timing a process or effect of a vibrato or the like, instructed by such a type of data, should take place. Therefore, it was not easy for the user to know an impression of a singing performance that would be given to the listeners.

When a singing performance is automatically executed using a singing synthesis apparatus, there can arise a slight deviation between sounding periods indicated by a singing score data set and sounding periods of voices in an actual singing performance. However, in the case where the conventionally-known score data displaying/editing apparatus is used, the user could not ascertain time (or temporal) relationship between the sounding periods indicated by the singing score data set and sounding periods of voices in the actual singing performance.

SUMMARY OF THE INVENTION

In view of the foregoing, it is an object of the present invention to provide a score data displaying/editing apparatus and program which allow a user to readily ascertain various types of data, included in score data, for a plurality of note data.

It is another object of the present invention to provide a score data displaying/editing apparatus and program which allow a user to readily ascertain time relationship between a sounding period of a sound included in a performance and timing or period when an instruction for imparting an expression to the sound should be executed.

It is still another object of the present invention to provide a score data displaying/editing apparatus and program which allow a user to readily ascertain time relationship between a sounding period of a sound indicated by singing score data used in a singing synthesis apparatus and a sounding period of a voice in a singing performance executed by the singing synthesis apparatus.

In order to accomplish the above-mentioned objects, the present invention provides a score data displaying/editing apparatus, which comprises: a storage section that stores score data including a plurality of note data, each of the note data including (a) fundamental attribute data composed of pitch data indicative of a pitch of a sound and sounding period data indicative of a sounding period of the sound, and (b) a plurality of types of additional attribute data indicative of attributes other than the pitch and sounding period of the sound; and a display section that, for each of the plurality of note data, displays a pictorial figure or symbol indicative of contents of the fundamental attribute data included in the note data and a letter, numeral, symbol or pictorial figure indicative of contents of the additional attribute data included in the note data, simultaneously in proximity to each other.

In the score data displaying/editing apparatus constructed in the above-identified manner, the contents of the additional attribute data of each of the selected types are displayed along with the contents of the pitch data and sounding period data, for a plurality of the note data, in proximity to each other. As a result, the user can readily ascertain correspondency between the plurality types of additional attribute data, along with relationship with additional attribute data included in note data that precede and succeed the note data including the additional attribute data in question.

The score data displaying/editing apparatus of the present invention may as further comprise: a state change section that sets, to a changeable state, one of the additional attribute data for each of which the letter, numeral, symbol or pictorial figure indicative of the contents is being displayed by the display section; and a data change section that changes the additional attribute data having been set to the changeable state by the state change section, or sets the additional attribute data, having been set to the changeable state, to a non-changeable state without changing the same. Here, the plurality of note data constituting the score data are segmented into a plurality of part data corresponding to a plurality of parts. When one of the additional attribute data is set to the non-changeable state by the data change section, the state change section selects one of the additional attribute data of one of the selected types on the basis of at least one of the pitch data, sounding period data and additional attribute data included in the part data that include the one additional attribute data, and then the state change section sets the selected additional attribute data to a changeable state.

When given additional attribute data is to be changed in the score data displaying/editing apparatus constructed in the above-identified manner, the contents of the other types of additional attribute data included in the same note data as the given additional attribute are displayed. Also, when the desired change of the given additional attribute data has been completed, the other types of additional attribute data included in the same note data, or other additional attribute data included in other note data are automatically set to a changeable state. As a result, the user can sequentially change a plurality of additional attribute data while ascertaining correspondency between the given additional attribute data and other types of additional attribute data included in the same note data.

Further, the score data displaying/editing apparatus of the present invention, the display section may display pictorial figures or symbols indicative of the contents of the fundamental attribute data of the note data included in the part data that include the additional attribute data set by the state change section to the changeable state, in a different style from pictorial figures or symbols indicative of the contents of the fundamental attribute data of the note data included in the part data that do not include the additional attribute data set by the state change section to the changeable state. With such an arrangement, the user can readily distinguish part data having particular additional attribute data set to a changeable state, from the other part data.

According to another aspect of the present invention, there is provided a score data displaying/editing apparatus, which comprises: a storage section that stores score data including a plurality of note data, each of the note data including (a) fundamental attribute data composed of pitch data indicative of a pitch of a sound and sounding period data indicative of a sounding period of the sound, (b) additional attribute data indicative of an attribute other than the pitch and sounding period of the sound, and (c) time data indicative of timing or period when control based on the additional attribute data is to be applied; and a display section that, for each of the plurality of note data, displays a pictorial figure or symbol indicative of contents of the fundamental attribute data included in the note data and a letter, numeral, symbol or pictorial figure indicative of contents of the additional attribute data included in the note data, simultaneously at a position specified on the basis of the time data included in the note data. With such an arrangement, time (temporal) relationship between the sounding period data and the additional attribute data included in the note data is displayed by positional relationship between pictorial figures representative of such data. As a result, the user can readily ascertain the relationship between the sounding period data and the additional attribute data included in the note data.

In the score data displaying/editing apparatus of the present invention, for each of the plurality of note data, the display section displays, on a coordinate plane having a first axis representative of a sound pitch and a second axis representative of passage of time and at a position, in a direction of the first axis, corresponding to the sound pitch indicated by the pitch data included in the note data, a pictorial figure having, as opposite end points thereof, positions, in a direction of the second axis, corresponding to start and end time points of the sounding period indicated by the sounding period data included in the note data. With such an arrangement, time (temporal) relationship between the sounding period data and the additional attribute data included in the note data is displayed only by positions on the coordinate plane. As a result, the user can ascertain with increased ease the relationship between the sounding period data and the additional attribute data included in the note data.

In the score data displaying/editing apparatus of the present invention, the display section may further display a pointer in the form of a pictorial figure or symbol indicative of a position on the coordinate surface, and there may be further provided: a position control section that controls the position of the pointer on the coordinate surface; a designation section that, when a letter, numeral, symbol or pictorial figure indicative of the contents of the additional attribute data is being displayed, by the display section, at a position pointed to or indicated by the pointer, designates the letter, numeral, symbol or pictorial figure; and a data change section that changes the contents of the additional attribute data being displayed in the letter, numeral, symbol or pictorial figure designated by the designation section, in accordance with a variation in the position of the pointer made by the position control section. With such an arrangement, the user can readily change time relationship between the sounding period data and the additional attribute data included in the note data, through simple operation using the pointer.

In the score data displaying/editing apparatus of the present invention, for each of the plurality of note data, the storage section may store, as the additional attribute data, data indicative of a partial voice waveform obtained by dividing a voice waveform corresponding to a word of a song in accordance with a phonetic characteristic of the voice waveform. Such an arrangement permits display of time relationship between the sounding periods indicated by the score data, used in a singing synthesis apparatus that executes an automatic singing performance, and phonetic elements of voices in a singing performance actually executed through an automatic performance. As a result, the user can readily understanding temporal relationship between the sounding periods indicated by the score data and voices in the actual singing performance The present invention also provides programs for causing a computer to perform processes similar to the processes performed by the above-identified inventive score data displaying/editing apparatus.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which:

FIG. 3 is a diagram showing an example organization of a singing score data set used in the embodiment;

FIG. 5 is a diagram showing an example organization of singing timing data used in the embodiment;

DETAILED DESCRIPTION OF THE EMBODIMENTS

Figure 1:
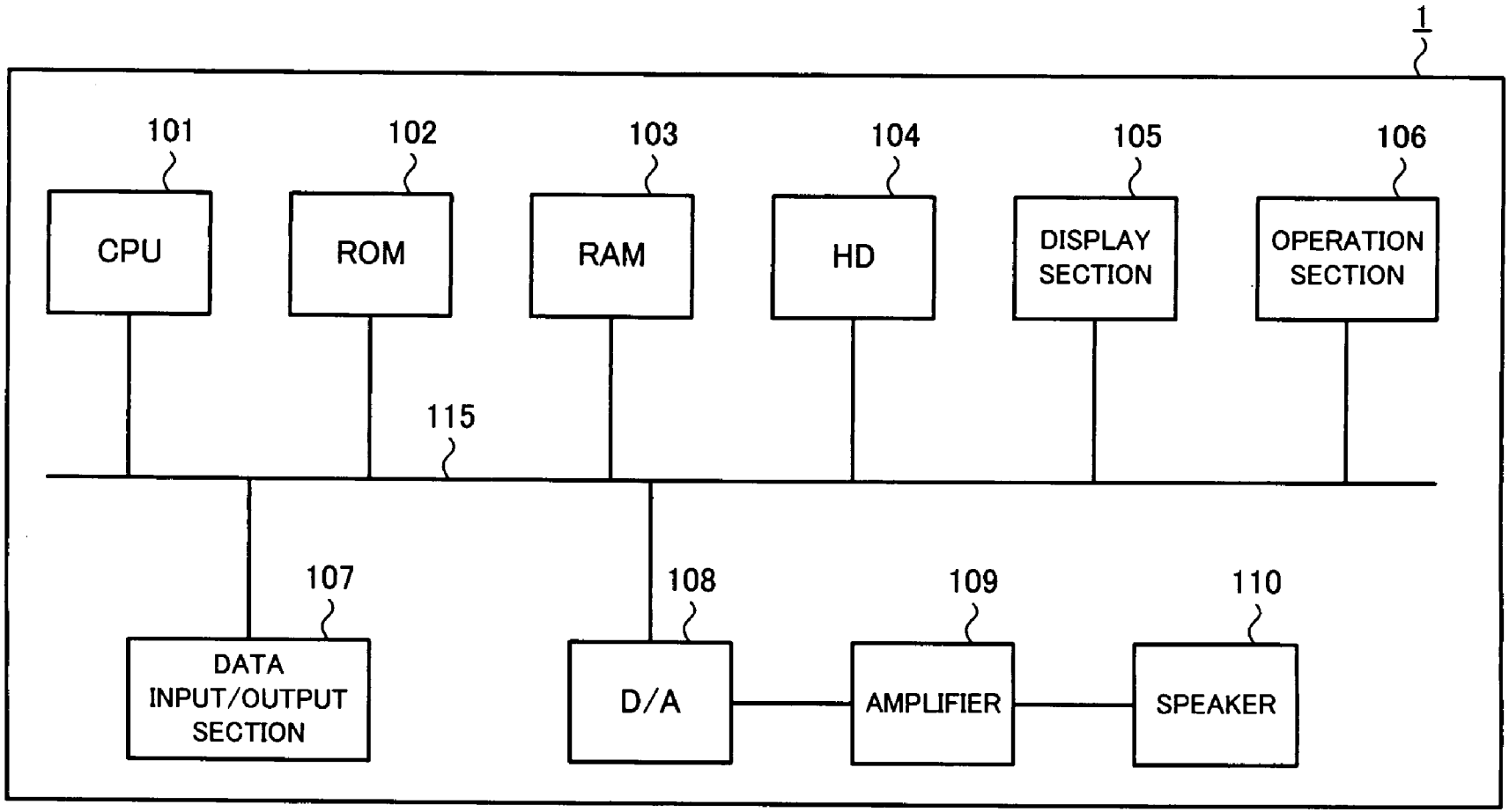
FIG. 1 is a block diagram showing an example general hardware setup of a computer system that implements a singing synthesis system in accordance with an embodiment of the present invention.

1. Embodiment of the Invention 1.1. Construction:

FIG. 1 is a block diagram showing an example general hardware setup of a computer system 1 that provides a singing synthesis system in accordance with an embodiment of the present invention. In the figure, the computer system 1 includes a CPU (Central Processing Unit) 101, a ROM (Read-Only Memory) 102, a RAM (Random Access Memory) 103, an HD (Hard Disk) 104, a display section 105, an operation section 106, a data input/output section 107, a D/A (Digital-to-Analog) converter 108, an amplifier 109, and a speaker 110. The above-mentioned components other than the amplifier 109 and speaker 110 are interconnected via a bus 115 to communicate data with one another.

The CPU 101, which is a general-purpose microprocessor, controls the various components of the computer system 1 in accordance with control programs, such as a BIOS (Basic Input/Output System) stored in the ROM 102 as well as an OS (Operating System) stored in the HD 104.

The ROM 102 is a nonvolatile memory storing the BIOS or other control programs, and the RAM 103 is a volatile memory provided for temporarily storing data for use by the CPU 101 and other components. The BIOS stored in the ROM 102 is read out in response to powering-on of the computer system 1 and written into the RAM 103. The CPU 101 establishes a hardware usage environment in accordance with the BIOS thus stored in the RAM 103.

The HD 104 is a large-capacity nonvolatile memory, and data stored in the HD 1104 are rewritable as desired. The OS, various application programs and data for use in the application programs are stored in the HD 104. After establishment of the hardware environment, the CPU 101 reads out the OS from the HD 104 and writes it into the RAM 103, in accordance with which the CPU 102 carries out various processes, such as establishment of a GUI (Graphical User Interface) environment and application execution environment.

Among primary application programs stored in the HD 104 is a singing synthesis application. Upon receipt of a user's instruction for executing the singing synthesis application given via operation of a mouse or otherwise, the CPU 101 reads out the singing synthesis application from the HD 104, writes the read-out application into the RAM 103, and constructs an environment for carrying out various processes in accordance with the singing synthesis application. In this way, the computer system 1 can function as a singing synthesis system of the present invention.

The display section 105, which includes a liquid crystal display (LCD) and a drive circuit for driving the liquid crystal display, displays various information, such as letters (including characters) and pictorial figures, under control of the CPU 101. The operation section 106, which includes a keypad, mouse, etc., transmits, to the CPU 101, data reflecting operation performed by the user.

The data input/output section 107, which is an interface, such as a USB (Universal Serial Bus), capable of inputting/outputting various data, receives data from external equipment, transfers the received data to the CPU 101 and transmits, to the external equipment, data generated by the CPU 101.

The D/A converter 108 receives digital voice data from the CPU 101, converts the received voice data into an analog voice signal, and outputs the converted signal to the amplifier 109. The amplifier 109 amplifies the analog voice signal so that the amplified signal is audibly reproduced as a sound.

Figure 2:
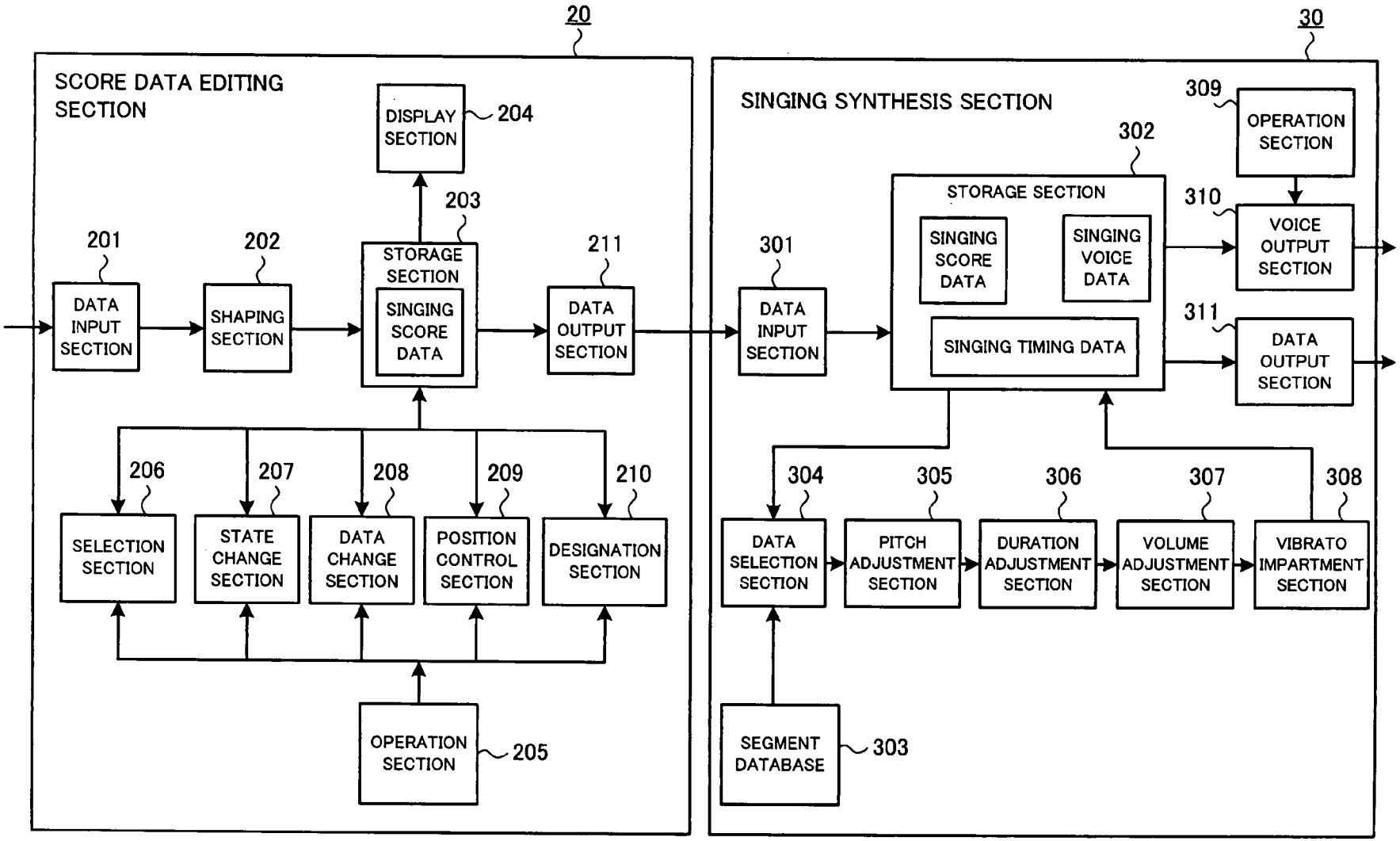
FIG. 2 is a block diagram showing various functions of the singing synthesis system.

FIG. 2 is a block diagram showing various functions of the singing synthesis system which are performed by the CPU 101. The singing synthesis system comprises a score data editing section 20, and a singing synthesis section 30. The score data editing section 20 is a module that displays a singing score data set to the user, edits the score data set in accordance with operation by the user, and passes the edited score data to the singing synthesis section 30. Here, the singing score data set includes pitch data indicative of respective pitches of time-serial singing sounds constituting a singing music piece, sounding period data each designating a sounding period, phonetic symbols corresponding to words of the singing music piece, etc. The singing synthesis section 30 is a module for synthesizing singing voice data on the basis of the singing score data.

The score data editing section 20 includes a data input section 201, a shaping section 202, a storage section 203, a display section 204, an operation section 205, a selection section 206, a state change section 207, a data change section 208, a position control section 209, a designation section 210, and a data output section 211. Of these components, the storage section 203 is implemented by the RAM 103 and HD 104 of the computer system 1. The other components than the storage section 203 are in the form of software modules constituting the singing synthesis application.

The singing synthesis section 30 includes a data input section 301, a storage section 302, a segment database 303, a data selection section 304, a pitch adjustment section 305, a duration adjustment section 306, a volume adjustment section 307, a vibrato impartment section 308, an operation section 309, a voice output section 310, and a data output section 311. Of these components, the segment database 303 and storage section 302 are implemented by the RAM 103 and HD 104 of the computer system 1. The other components than the segment database 303 and storage section 302 are in the form of software modules constituting the singing synthesis application.

Functions of the score data editing section 20 and singing synthesis section 30 will be later explained in relation to behavior of the instant embodiment, to avoid unnecessary duplication.

1.2. Behavior of the Embodiment:

Primary features of the present invention reside in the score data editing section 20. However, in order to understand technical significance of processing carried out by the score data editing section 20, it is preferred to understand in advance processing carried out by the singing synthesis section 30 for singing synthesis using output data of the score data editing section 20. Thus, hereinafter, operation of the singing synthesis section 30 will be described first, and then operation of the score data editing section 20 will be described.

The data input section 301 of the singing synthesis section 30 receives singing score data from the score data editing section 20 and stores the received singing score data in the storage section 302.

FIG. 3 is a diagram showing an example organization of the singing score data set. The singing score data set includes one or more part data representative of a singing performance, data indicative of a musical time and tempo used in the performance, and data indicative of resolution. Specifically, the singing score data set of FIG. 3 includes part data of "part 1" to "part 3", data indicative of "four-four time", data indicative of a tempo value "120", and data indicative of a resolution value "480". The tempo value "120" indicates that the music piece represented by the singing score data set is performed at a tempo of 120 quarter notes per minute, and the resolution value "480" indicates that the singing score data set uses a minimum time unit equal to 1/480 of a quarter note.

Each of the part data includes, in corresponding relation to a plurality of singing sounds of the performance part, a plurality of note data each including data related to (or indicative of) a pitch and sounding period, and data related to a phonetic symbol, note velocity, accent intensity, legato intensity, vibrato intensity, vibrato period or the like.

The data related to (or indicative of) the pitch and sounding period are "fundamental attribute data" essential for instructing generation of a sound. The data related to the phonetic symbol, note velocity, accent intensity, legato intensity and vibrato intensity are "additional attribute data" for instructing impartment of an expression etc. to the sound; the type of the additional attribute data to be used is of course variable because the additional attribute data is an addition to the fundamental attribute data. Further, the data related to the vibrato period is time data indicating which period of the sound represented by the fundamental attribute data the expression indicated by the vibrato intensity, one of the additional attribute data, should be applied to.

The data related to the sounding period includes data indicative of a start time point and end time point of the sounding period. The data related to the vibrato period includes data indicative of a start time point and time length of the vibrato period. In the part data, a plurality of the above-described note data are arranged, for example, in descending order of the start time point of the vibrato period with the earliest start time point first; for two or more note data that indicate the same start time point, these two or more note data are arranged in descending order of the pitch. Further, each of the note data is assigned a unique identification number. Hereinafter, note data assigned an identification number "N1001" will be represented as "note N1001", and other note data assigned respective identification numbers will be represented in a similar manner.

In the instant embodiment, each of the data indicative of the start and end time points of the sounding period, included in the singing score data set, is expressed by a combination of "measure number+beat number+minimum time unit number". For example, "0005: 03: 240" indicates a 240th minimum time unit from the third beat of the fifth measure, i.e. a time point when a time corresponding to a half beat has passed from the third beat of the fifth measure. However, various time points in the singing score data set may be expressed by various other format than the combination of "measure number+beat number+minimum time unit number", such as the commonly-known combination of "hour+minute+second". Further, timing of particular data may be specified by a relative time from preceding data, instead of an absolute time from a reference time point.

In the instant embodiment, the intensity of each sound is represented by a numerical value in a range of "0"–"127". Further, the term "accent " refers to a musical expression to emphasize a rising portion of a sound, and the intensity of the accent is represented by any one of letters "H", "M" and "L" corresponding to "High (or strong)", "Medium" and "Low (or weak)". The term "legato" concerns two adjacent sounds differing in pitch from each other, and it refers to a musical expression for carrying out a smooth sound change. The intensity of the legato is represented by any one of letters "H", "M" and "L", similarly to the intensity of the accent. Let it be assumed that, in the instant embodiment, the legato-related data is attached to a preceding one of two adjacent sounds to be imparted with a legato. The term "vibrato" refers to a musical expression for imparting vibration to a sound, and the intensity of the vibrato is represented by any one of letters "H", "M" and "L", similarly to the intensity of the accent. For each note data that is not imparted with an accent, legato or vibrato, a corresponding location in the score data set is left blank.

The start time point of the vibrato period indicates start timing of a period when a vibrato should be imparted to the sound represented by the note data. Specifically, the start time point is expressed by a numerical value that represents a time length from the start time point of the sounding period to the start time point of the vibrato in terms of the number of the minimum time units. Time length of the vibrato is expressed by a numerical value that represents, in terms of the number of the minimum time units, a time length over which the vibrato should be applied.

Once a singing score data set as explained above is stored in the storage section 302 by the data input section 301, the data selection section 304 reads out, from the segment database 303, data necessary for generating singing voice data for each singing sound designated by the singing score data set.

Figure 4:
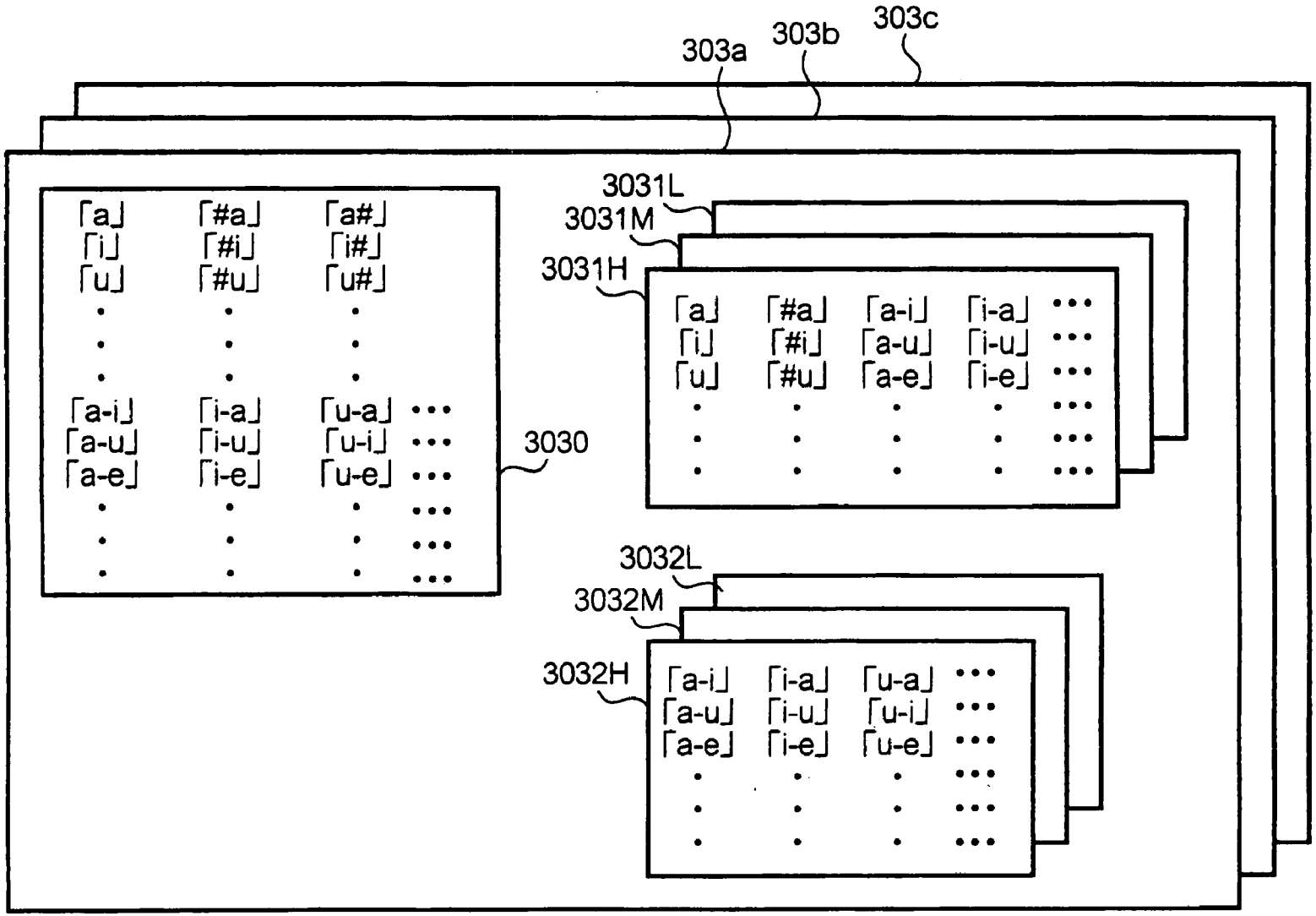
FIG. 4 is a diagram showing an example organization of a segment database employed in the embodiment.

FIG. 4 is a diagram showing an example organization of the segment database 303, which comprises individualized databases corresponding to a plurality of singers. In the illustrated example of FIG. 4, the segment database 303 includes individualized databases 303*a*–303*c* corresponding to three singers.

Each of the individualized databases, corresponding to the plurality of singers, includes a plurality of segment data sampled from singing voice waveforms of the singer. The segment data are voice data obtained by extracting phonetic characteristic portions from the singing voice waveforms and encoding the thus-extracted characteristic portions.

Now, the segment data will be explained in relation to a case where Japanese words "saita" (corresponding to English words "blossomed") are sung. Analyzing phonetic characteristics of a waveform of voices represented by "saita" shows that the waveform begins with a rise portion of the consonant sound "s", followed by a body portion of the sound "s", a transient portion from the body portion of the sound "s" to the vowel sound "a" and the body portion of the sound "a", . . . , and then ends in a decay portion of the sound "a". The individual segment data are voice data corresponding to the phonetic characteristics.

In the following description, a "#" symbol is attached to segment data corresponding to a rise portion of a sound, indicated by a given phonetic symbol, immediately preceding the phonetic symbol so that the segment data is represented, for example, as "#s". Further, a "#" symbol is attached to segment data corresponding to a decay portion of a sound, indicated by a given phonetic symbol, immediately following the phonetic symbol so that the segment data is represented, for example, as "a#". Furthermore, a "-" mark is attached to segment data corresponding to a transient portion from a sound indicated by one phonetic symbol to a sound indicated by another phonetic symbol so that the segment data is represented, for example, as "s-a".

Segment data group 3030 in the segment database 303 contains segment data that pertain to all sounds and combinations of sounds sampled from singing voice waveforms obtained by the singer singing in an ordinary manner.

Further, segment data groups 3031H–3031L in the segment database 303 include segment data that pertain to all sounds and combinations of sounds sampled from singing voice waveforms obtained by the singer singing while giving strong (H), medium (M) and weak (L) accents, respectively. However, because no accent is given to a decay portion of a sound, the segment data groups 3031–3031L include no segment data corresponding to a decay portion of a sound.

Furthermore, segment data groups 3032H–3032L in the segment database 303 include segment data that pertain to all combinations of sounds sampled from singing voice waveforms obtained by the singer singing while giving strong (H), medium (M) and weak (L) legatos, respectively. Let it be assumed that, in the instant embodiment, the legato is a musical expression imparted to a transient portion between sounds; therefore, the segment data groups 3032H–3032L only include segment data corresponding to transient portions of sounds. Note that a legato may be applied to other segment data than segment data corresponding to a transient portion between sounds as noted above.

Next, a description will be given about a process carried out by the data selection section 304 for reading out, from the segment database 303, segment data necessary for generating singing voice data, with reference to FIG. 3.

First, in the arranged order of the note data in the singing score data set, the data selection section 304 refers to the start and end time points of the sounding periods of the individual note data, so as to determine whether a difference between the sounding period end point of a preceding one of the adjacent note data and the sounding period start time of a succeeding one of the adjacent note data. If the difference is smaller than a predetermined time length, e.g. 48 minimum time units, the data selection section 304 judges that voices represented by phonetic symbols of the two note data are to be sounded successively. If, on the other hand, the difference is not smaller than the predetermined time length, the data selection section 304 judges that the voices represented by the phonetic symbols of the two note data are to be sounded separately at some time interval. In the illustrated example of FIG. 3, the data selection section 304 judges that the phonetic symbols of notes N1001–N1003 are to be sounded successively and the phonetic symbols of note N1004 and subsequent notes are to be sounded separately from notes N1001–N1003, Then, the data selection section 304 sequentially joins together the phonetic symbols having been judged to be sounded successively, so as to create a successive string of phonetic symbols; in the illustrated example of FIG. 3, a string "sakura" is created. After that, the data selection section 304 breaks the created string of phonetic symbols down into a plurality of segment data. For example, the string "sakura" is broken down into a plurality of segment data, "#s", "s", "s-a", "a", "a-k", "k", "k-u", "u", "u-r", "r", "r-a", "a".

After that, the data selection section 304 refers to the data related to the accent and legato intensity of the individual note data, and reads out, from pertinent segment data groups, the segment data "#s", "s", "s-a", "a", "a-k", "k", "k-u", "u", "u-r", "r", "r-a", "a", "a#". For example, regarding note N1001, for which the accent intensity "H" is specified, the segment data corresponding to note N1001, i.e. "#s", "s", "s-a" and "a", are read out from the segment data group 3031H. The data selection section 304 transmits the thus read-out segment data to the pitch adjustment section 305 along with the singing score data.

The pitch adjustment section 305 performs pitch adjustment on the segment data, received from the data selection section 304, on the basis of the pitch-related data included in the singing score data. The pitch adjustment section 305 transmits the pitch-adjusted segment data to the duration adjustment section 306 along with the singing score data.

The duration adjustment section 306 performs duration adjustment on the segment data, received from the pitch adjustment section 305, on the basis of the sounding-period-related data included in the singing score data. The following paragraphs describe duration calculation procedures for performing time adjustment on the segment data.

The duration adjustment section 306 creates singing timing data corresponding to the received segment data and writes the created singing timing data into the storage section 302. FIG. 5 is a diagram showing an example organization of the singing timing data. The singing timing data include, for each of the segment data, various data blocks for a segment number, segment name, segment time length, information as to whether the segment is a vowel segment or not, a start time point of a sounding period and adjusted segment time length. When all the segment data have been received, the duration adjustment section 306 creates a blank form for the singing timing data including these blocks, and it writes a series of segment numbers into the segment number block and names of the individual segment data into the segment name block.

After that, the duration adjustment section 306 calculates a time length of the segment represented by each of the segment data, on the basis of a data quantity of the segment data. In the illustrated example of FIG. 5, the segment data of segment number "1" is voice data having a time length equal to 15 (fifteen) minimum time units. Then, for each of the segment data which is located at an intermediate position of the segment string and which represents a vowel, the duration adjustment section 306 writes a "YES" into the vowel segment block. Hereinafter, such segment data for which a "YES" has been written in the vowel segment block will be referred to as "vowel segment data". In the illustrated example of FIG. 5, segment numbers "4", "8" and "12" represent such vowel segment data.

Subsequently, the duration adjustment section 306 refers to the data indicative of the phonetic symbols in the singing score data and identifies the note data corresponding to the vowel segment data. In this case, segment numbers "4", "8" and "12" correspond to notes N1001, N1002 and N1003. Then, the duration adjustment section 306 writes, into the sounding-period start time point block pertaining to the vowel segment data, data indicative of a sounding-period start time point, in the singing score data, of the corresponding note data. For example, the segment data of segment number "4" in the singing score data pertains to the segment of the vowel "a", and this vowel "a" belongs to the phonetic symbols "sa" allocated to the segment data of segment number "4". Therefore, "0001: 01: 020", indicative of a sounding-period start time point of note N1001 in the singing score data, is written into the sounding-period start time point block of the segment data of segment number "4".

After that, the duration adjustment section 306 writes, into the sounding-period start time point block pertaining to the last segment data, i.e. segment data of segment number "13", data indicative of a sounding-period end time point, in the singing score data, of the corresponding note data. For example, the note data corresponding to the segment data of segment number "13" is that of note N1003, and the sounding-period end time point in the singing score data is represented by "0001: 04: 424", so that "0001: 04: 424" is written into the sounding-period start time point block of the segment data of segment number "13".

In the instant embodiment, the segment time length adjustment is performed such that a sounding-period start time point of a sound indicated by vowel segment data agrees with timing indicated by a sounding-period start time point of note data in the singing performance data, as set forth above. This is because the singer often sings in such a manner as to start uttering a vowel sound at a sounding-period start time point indicated by a note. Further, in the instant embodiment, the segment time length adjustment is performed such that, at the end of a successive string of phonetic symbols, a sounding-period end time point of a sound indicated by vowel segment data agrees with timing indicated by a sounding-period end time point of note data in the singing score data. This is because, at an end portion of words to be sounded in succession, the singer often ends uttering a vowel sound at a sounding-period end time point indicated by a note. However, the present invention may employ various other timing setting methods than the above-described; for example, a sounding-period start time point in a transient portion from a consonant to a vowel may be set to agree with a sounding-period start time point indicated by note data.

Then, the duration adjustment section 306 sequentially subtracts the segment time length of preceding segment data from the sounding-period start time point of each individual vowel segment data, and it writes resultant timing-related data into the sounding-period start time point block of the preceding segment data. For example, the sounding-period start time point of the segment data of segment number "3" is determined as "000: 04: 468" by subtracting the segment time length "032" of segment number "3" from the sounding-period start time point "0000: 01: 020" of the vowel segment of segment number "4". Similarly, the sounding-period start time point of the segment data of segment number "2" is determined as "000: 04: 455" by subtracting the segment time length "013" of segment number "2" from the sounding-period start time point "0000: 04: 468" of the segment of segment number "3".

Then, the duration adjustment section 306 calculates an actual time length of the vowel segment data on the basis of the sounding-period start time point and sounding-period end time point of the vowel segment data, and it writes the thus-calculated time length as an adjusted segment time length. For example, the time length of the vowel segment of segment number "4" is determined as "345" by subtracting the sounding-period start time point of segment number "4" from the sounding-period start time point of segment number "5". Further, the duration adjustment section 306 writes segment time lengths of the other segment data than the vowel segment data into the respective adjusted segment time length blocks. With the foregoing operations, completed singing timing data are stored into the storage section 302.

The duration adjustment section 306 performs duration adjustment on the vowel segment data on the basis of the segment time length data of the singing timing data and adjusted segment time length data. Whereas the duration adjustment has been described above as performed only on the vowel segment data, other segment data than the vowel segment data may be subjected to the duration adjustment in accordance with the tempo and/or the like of the singing score data. The duration adjustment section 306 transmits all the segment data, having been subjected to the necessary time adjustment as set forth above, to the volume adjustment section 307 along with the singing score data.

The singing score data transmitted to the volume adjustment section 307 include data related to intensity of sounds corresponding to different segment data. The volume adjustment section 307 performs sound volume adjustment on each of the segment data on the basis of the intensity-related data. Further, for the segment data having been subjected to the volume adjustment, the volume adjustment section 307 adjusts a sound volume a trailing end or leading end portion of the segment data so that the trailing end of the preceding segment data and the leading end of the succeeding segment data coincide with each other in sound volume. The volume adjustment section 307 connects together the volume-adjusted segment data, and it transmits the thus-connected voice data to the vibrato impartment section 308 along with the singing score data.

The singing score data transmitted to the vibrato impartment section 308 include data related to vibrato intensity and vibrato period. On the basis of such data, the vibrato impartment section 308 makes volume and pitch variations to the voice data received from the volume adjustment section 307. The vibrato impartment section 308 stores the volume- and pitch-varied voice data in the storage section 302 as singing voice data.

Once the user operates the operation section 309 to give a reproduction instruction to the singing synthesis section 30, the voice output section 310 reads out the singing voice data from the storage section 302 and outputs the read-out singing voice data to the D/A converter 108. As a result, the user can listen to a singing performance represented by the singing score data.

In order to make more natural the singing performance by the singing synthesis section 30, a plurality of further segment data corresponding to different tempos and pitches, or other musical expressions than accent and legato, may be stored in the segment database 303, regarding characteristic portions of sounds expressed by same phonetic symbols. In this case, the data selection section 304 may be caused to read out optimal ones of the further segment data.

Although, in the foregoing description, the segment data used in the singing synthesis section 30 are voice data obtained by encoding voice waveforms, the format of the segment data is not limited to this. For example, parameterized characteristics of frequency components of voice data obtained from voice waveforms may be stored in the segment database 303 as segment data, and voice data may be re-generated, by the data selection section 304 or the like, on the basis of the parameters included in the segment data, so as to generate singing voice data.

The score data editing section 20 operates as follows. In FIG. 2, the data input section 201 of the score data editing section 20 receives singing score data from external equipment and transmits the received singing score data to the shaping section 202. The singing score data received from the external equipment is constructed similarly to the singing score data illustrated in FIG. 3.

The shaping section 202 rearranges note data, included in each of the part data of the singing score data, in descending order of the start time point with note data of the earliest start time point first, or in descending order of the pitch with the highest pitch first for note data having the same sounding-period start time point. The shaping section 202 stores the note-data-rearranged singing score data in the storage section 203. The following description assumes that singing score data as illustratively shown in FIG. 3 are stored in the storage section 203 by the shaping section 202.

Figures 6, 7:
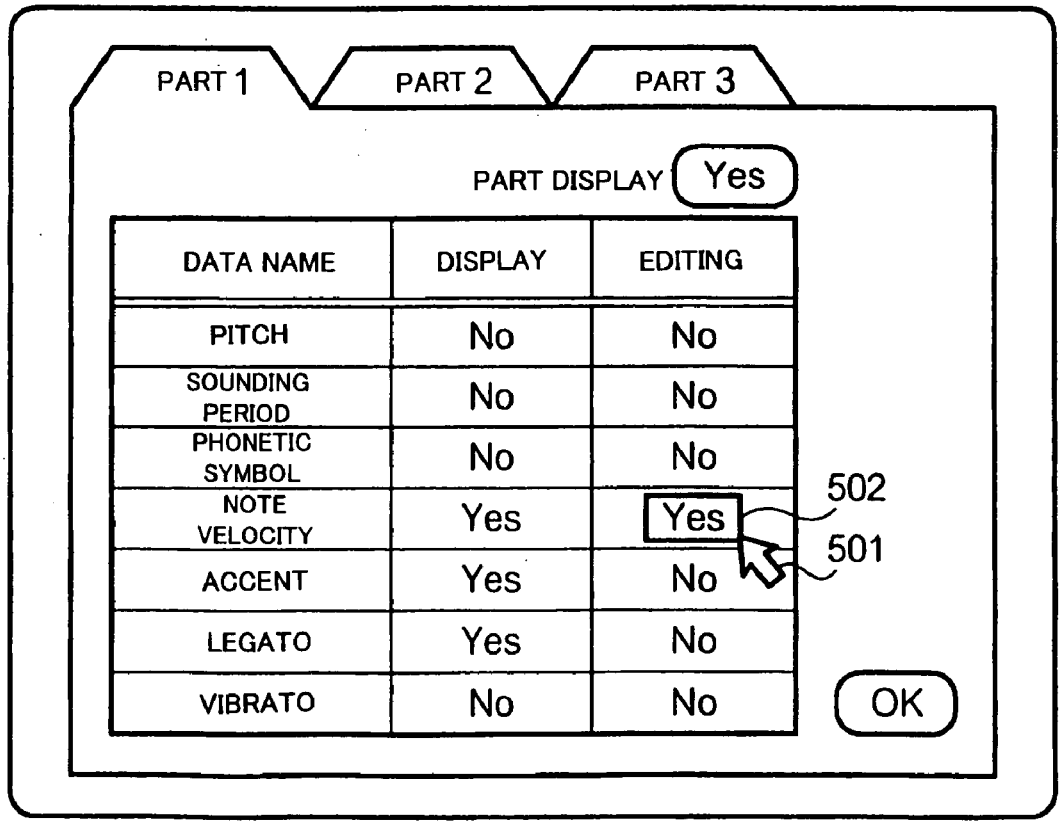
FIG. 6 is a diagram showing an example organization of displaying/editing instruction data used in the embodiment.
FIG. 7 is a diagram showing a message window displayed in response to an instruction of a selection section in the embodiment.

1.2.1. Display and Change of Ordinary Data:

Once the singing score data are stored in the storage section 203 in response to an instruction given from the shaping section 202, the selection section 206 creates displaying/editing instruction data in accordance with items of data stored in the singing score data, and it stores the thus-created displaying/editing instruction data in the storage section 203. FIG. 6 is a diagram showing an example organization of the displaying/editing instruction data.

The displaying/editing instruction data include a plurality of data sheets corresponding to the part data included in the singing score data. Each of the data sheets includes part indicating data that indicates, by "YES" or "NO", whether or not the part data should be displayed. At a time point when the displaying/editing instruction data have been created by the selection section 206, a "YES" is written as default at the part indicating data position of all the part data.

Each of the data sheets corresponding to the part data includes a data name column, display column and editing column. In the data name column, there are written respective names of data items included in the singing score data. At that time, data closely interrelated to each other, such as the sounding-period start and end time points, are combined as single data. In the display column, there is written a "YES" or "NO" indicating whether or not the corresponding data should be displayed. However, because data related to a pitch and sounding period are always displayed as long as "a YES" is selected in a part display block, "-" indicating that the user can not make the part display selection. Similarly, in the editing column, there is written a "YES" or "NO" indicating whether or not the corresponding data should be made editable. At the time point when the displaying/editing instruction data have been created by the selection section 206, a "NO" is written as default in each of the blocks for the pitch and sounding period data.

Then, the selection section 206 causes the display section 204 to display a message window as shown in FIG. 7 for prompting the user to check and change the displaying/editing instruction data as necessary. The display section 204 displays a mouse pointer 501 on the message window and on a piano roll display screen to be later described.

The mouse pointer 501 is a pictorial figure for the user to designate a particular point on the screen. As the user performs operation such as one for moving the mouse in a front-and-rear direction or left-and-right direction on a desk, the operation section 205, in response to the mouse operation, transmits position data to the position control section 209. On the basis of the position data, the position control section 209 indicates, to the display section 204, a position on the screen where the mouse pointer 501 should be displayed. The display section 204 redisplays the mouse pointer 501 at a position as instructed by the position control section 209.

The user can perform a desired operation on a pictorial figure or the like displayed at the position pointed to by the mouse pointer 501, by clicking the mouse or otherwise. For example, once the user moves the mouse pointer 501 to a cell 502 and then clicks the mouse, the position control section 209 identifies the position of the cell 502 as the current position of the mouse pointer 501 and transmits, to the selection section 206, data indicating that the cell 50 has been clicked on.

Then, the selection section 206 reads out, from the displaying/editing instruction data, data corresponding to the cell 502 and sets the read-out data to a changeable state. The display section 204 displays letters of the cell 502, for example, in boxed form, so as to indicate to the user that the data corresponding to the cell 502 is now in a changeable state.

Once the user instructs a change after having set particular data to a changeable state, the selection section 206, in accordance with the user's change instruction, changes the data read out earlier and then rewrites or updates the displaying/editing instruction data with the changed data.

Once the user clicks on "OK" after designating, by "YES" and "NO", part data to be displayed and types of data to be displayed and edited, the selection section 206 stores the displaying/editing instruction data, having been changed in accordance with user's instructions, in the storage section 203.

Figure 8:
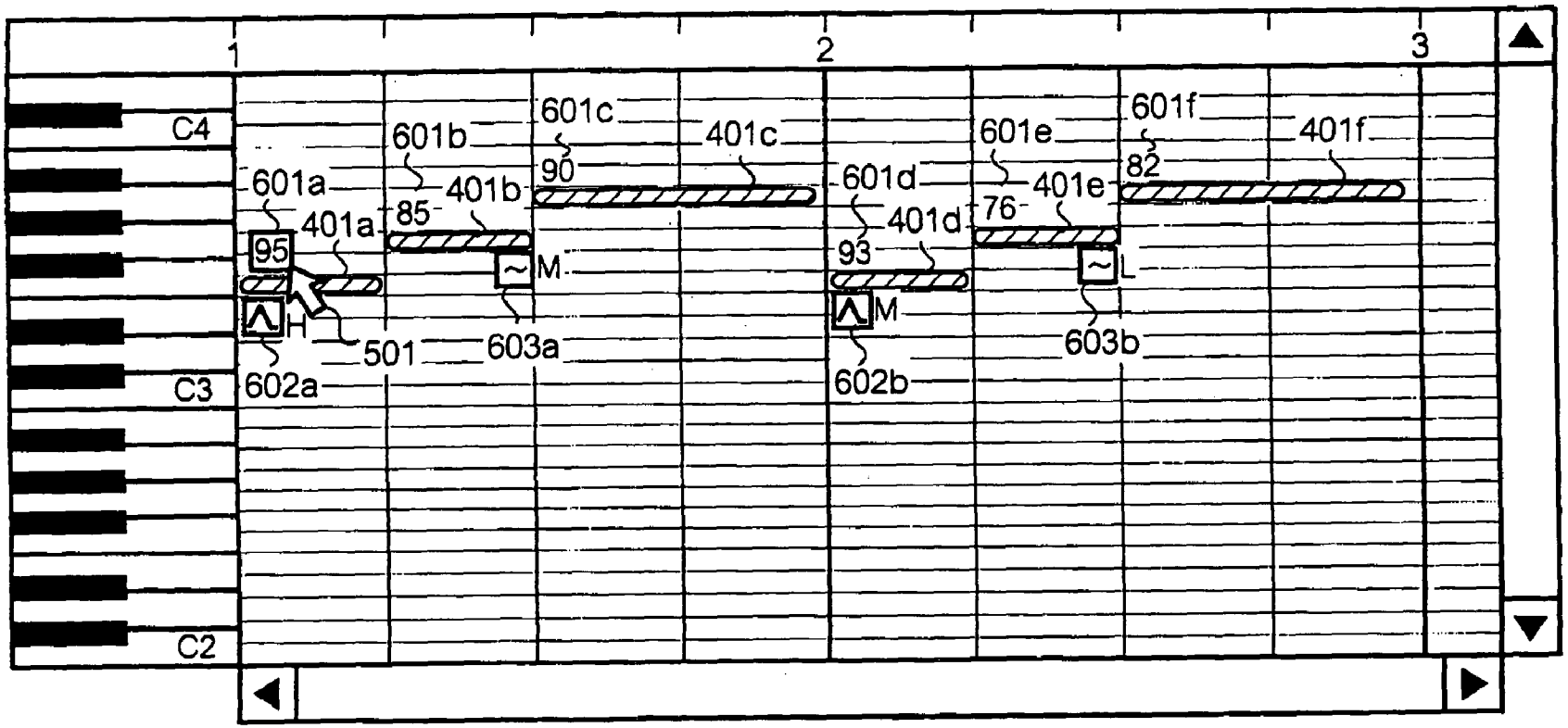
FIG. 8 is a diagram, showing an example of a piano roll screen displayed in the embodiment.

Then, the display section 204 displays a piano roll screen on the basis of the singing score data and displaying/editing instruction data. FIG. 8 shows an example of the piano roll screen displayed by the display section 204 when the user has instructed display of only "part 1" and has instructed that data related to note velocity, accent and legato be displayed for "part 1" and that editing of the note velocity should be enabled.

In FIG. 8, note numbers 401*a*–401*f* correspond to different note data. Vertical direction (vertical axis) of the screen represents the sound pitch, and, via a schematic picture of a keyboard shown on a left end portion of the figure, the user can ascertain a pitch of note data indicated by each note bar. Horizontal direction (horizontal axis) of the screen represents the passage of time, and, on the basis of left and right end positions of a note bar, the user can ascertain sounding-period start and end time points of note data indicated by the note bar. Once display of a plurality of the part data is instructed by the user, the display section 204 displays note bars using a different color per part data.

Reference numerals 601*a*–601*f* in FIG. 8 each represent note velocity of note data corresponding to a note bar displayed immediately below the numeral. Reference numerals 602*a* and 602*b* each indicate that an accent is put to note data corresponding to a note bar displayed immediate above the reference numeral. Alphabetical letters shown to the right of reference numerals 602*a* and 602*b* each indicate intensity of the accent. Reference numerals 603*a* and 603*b* each indicate that a legato is imparted to note data corresponding to a note bar displayed immediate above the reference numeral. Alphabetical letters shown to the right of reference numerals 603*a* and 603*b* each indicate intensity of the legato.

The user can vary the data related to note velocity on the screen of FIG. 8. For example, once the user moves the mouse pointer 501 to the data denoted by numeral 601*a* using the mouse, the position control section 209 transmits, to the state change section 207, data indicating that the data denoted by numeral 601*a* has been clicked on.

With reference to the singing score data, the state change section 207 determines that the data corresponding to reference numeral 601*a* is data pertaining to the note velocity of part "1". Then, with reference to the displaying/editing instruction data, the state change section 207 determines whether or not a "YES" is currently set in the editing block for the note velocity of "part 1". If a "YES" is not currently set in the editing block for the note velocity of "part 1", the state change section 207 performs nothing in particular, but, if a "YES" is currently set in the editing block, the state change section 207 instructs the data change section 208 to set the data corresponding to reference numeral 601*a* to a changeable state.

Then, the data change section 208 reads out, from the singing score data, the data corresponding to the numeral 601*a*, i.e. note velocity of note N1001, and sets the read-out data to a state changeable by the user. The display section 204 displays the data corresponding to numeral 601*a*, for example, in boxed form. The display section 204 also displays all note bars of "part 1", including the data now set in the changeable state, in shaded (hatched) form. FIG. 8 shows the screen with such boxed data and hatched note bars displayed by the display section 204. The note bars of the part data, having some note set in the editable state, may be visually distinguished from the note bars of the other part data in various other desired manners than displaying them in hatched form, such as by displaying them in a different color or line thickness from the note bars of the other part data or by causing them to blink.

Thereafter, the user gives an instruction for changing the numeral data represented by reference numeral 601*a* or maintaining the current numeral data with no change, using the keypad or otherwise. If the instruction for changing the numeral data has been given by the user, the data change section 208 changes the earlier-read-out data in accordance with the instruction, rewrites or updates the singing score data with the changed data and sets the changed data back to a non-changeable state. If the instruction for maintaining the current numeral data has been given by the user, the data change section 208 sets the earlier-read-out data back to a non-changeable state without changing the data.

Once the note-velocity-related data of note N1001 is set back to the non-changeable state, the state change section 207 designates data to be next set to a changeable state, with reference to the singing score data. In this case, the state change section 207 designates note-velocity-related data of note N1002 immediately following node N1001 in the singing score data. Then, the state change section 207 instructs the data change section 208 to set the note-velocity-related data of note N1002 to a changeable state.

After that, the above-described data change process is sequentially repeated for subsequent note data of "part 1". As a consequence, the user can sequentially change data of the same type included in different note data, in a manner like "601*a*→601*b*→601*c*, . . . ". The data change process is brought to an end once the process is completed for the last note data in the part data of "part 1" or the user instructs termination of the process.

In the case where the user has designated a "YES" in the editing blocks for a plurality of types of data on the message window of FIG. 7, and when the data change process has been completed for given data, the state change section 207 may either select data of the same type in the succeeding note data or select data of another type in the same note data, as data to be next set to the changeable state. If, in the latter case, a "YES" is designated in the editing blocks for "accent" and "legato" on the message window of FIG. 7, the user can sequentially change data of inter-related different types included in different note data, in a manner like "602*a*→603*b*→602*b*, . . . ".

Whereas the selection of the note data to be subjected to the data change process has been explained as being made in the descending order of the sounding-time start time point with the earliest start time point first, or in the descending order of the pitch when a plurality of note data have a same sounding-time start time point, in accordance with the arranged order of the singing score data, the present invention is not so limited; for example, the selection order may be determined on the basis of desired data, such as note velocity data. Further, the selection may be made only from among note data that include data satisfying a predetermined condition. For example, if the user gives an instruction for sequentially changing note-velocity-related data in ascending order of the note velocity only for accented note data, the user can sequentially change the data in order like "numeral 601*d*→601*a*".

Figure 9:
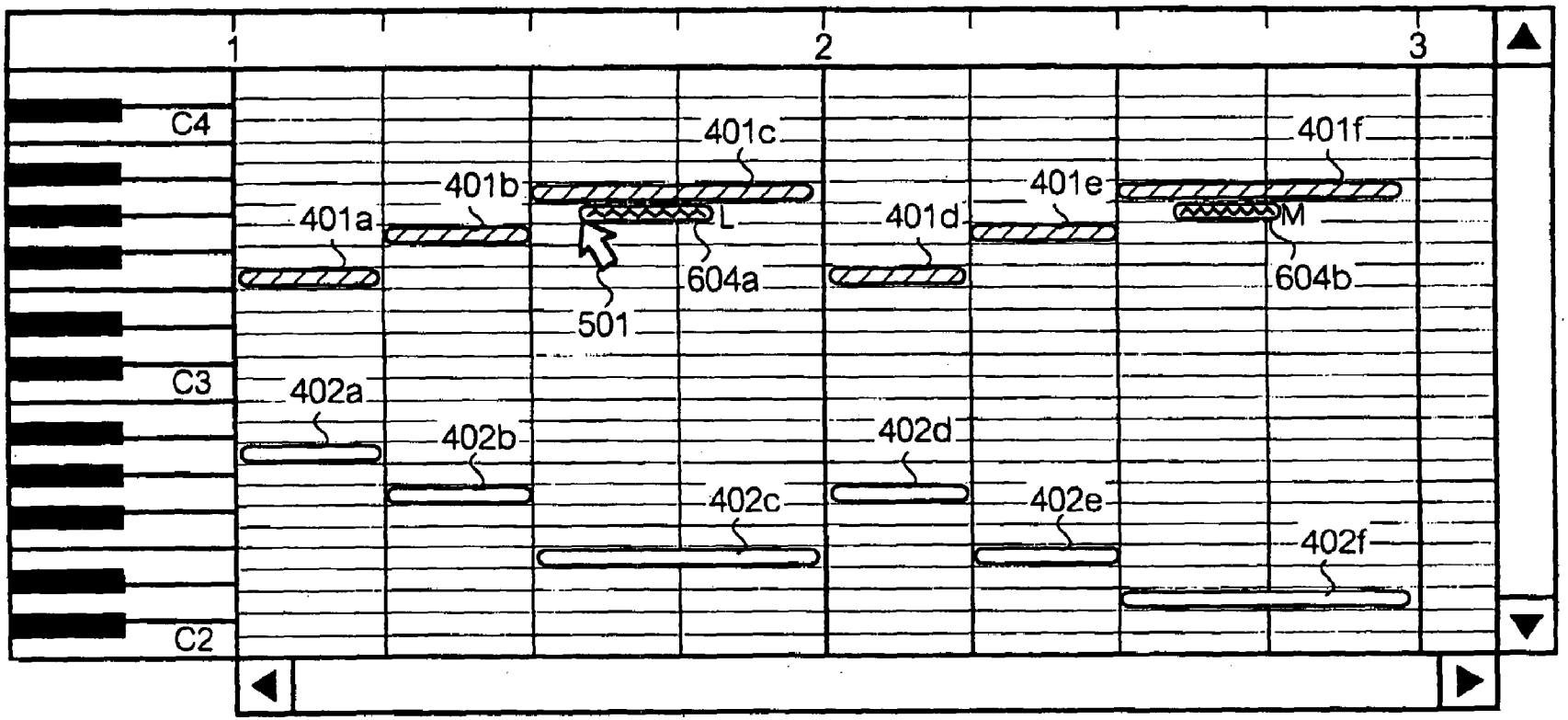
FIG. 9 is a diagram, showing another example of the piano roll screen displayed in the embodiment.

1.2.2. Display and Change of Additional Attribute Data Application Period or Application Timing:

At any desired time, the user can cause the message window of FIG. 7 to be displayed and change the contents of the displaying/editing instruction data. FIG. 9 shows an example of a piano roll screen that is displayed when the user, on the message window of FIG. 7, designates a "YES" in part display blocks of "part 1" and "part 2", designates a "NO" in the other blocks and then clicks on "OK".

On the screen of FIG. 9, note bars 402*a*–402*f* correspond to note data included in "part 2". Graphic symbols 604*a* and 604*b* show that note data corresponding to note bars indicated immediately above the symbols 604*a* and 604*b* are each imparted with a vibrato. Further, letters shown to the right of the symbols 604*a* and 604*b* each represent intensity of the vibrato.

As set forth above in relation to FIG. 3, the vibrato-related data include data of intensity of a vibrato, start time point of a vibrato period and time length of the vibrato period. Namely, the "vibrato-period start time point" indicative of a time period when an expression indicated by the "vibrato intensity" should be applied and the "vibrato-period time length" are associated, as time data, with the "vibrato intensity" as additional attribute data. On the basis of the vibrato-period start time point and vibrato-period time length, the display section 204 displays, in relation to the corresponding note bar, a pictorial figure indicative of the vibrato period at a suitable time-representing horizontal position and in a suitable size.

Referring to the illustrated example of FIG. 3, the vibrato-period time point of note N1003 is "120", and the time length of the vibrato period is "480". On the basis of these data, the display section 204 displays the pictorial figure 604*a* in such a manner that the left end of the symbol 604*a* falls at a location displaced rightward a distance of 120 minimum time units from the left end of a note bar 401*c* corresponding to note N1003, and in such a manner that the pictorial figure 604*a* has a horizontal length equal to 480 minimum time units.

On the screen of FIG. 9, the user can change the positions and sizes of the pictorial figures 604*a* and 604*b*. For this purpose, the user, for example, moves the mouse pointer 501 close to the middle of the pictorial figure 604*a*, performs dragging and dropping operations of the pictorial figure 604*a* by depression and movement of the mouse button and, after completion of the dragging and dropping operations, the user releases the mouse button.

In this case, when the mouse button has been depressed, the position control section 209 transmits, to the designation section 210, data indicating that the mouse button has been depressed near the middle of the pictorial figure 604*a*. Then, with reference to the singing score data, the designation section 210 determines that the data corresponding to the pictorial figure 604*a* is vibrato-related data of "part 1". Then, with reference to the display/displaying instruction data, the designation section 210 makes a determination as to whether an "YES" is currently set in the editing block for vibrato of "part 1". If answered in the negative, the designation section 210 performs no operation in particular, while, if answered in the affirmative, the designation section 210 instructs the data change section 208 to set the data corresponding to reference numeral 601*a* to a changeable state.

In response to the instruction from the designation section 210, the data change section 208 reads out the vibrato-period start time point of note N1003 from the singing score data and sets the read-out vibrato-period start time point to a changeable state. Then, at a time point when the user has released the mouse button, the position control section 209 transmits, to the data change section 208, data indicative of a moved direction and distance of the mouse, i.e. mouse pointer 501.

Then, the data change section 208 changes the earlier-read-out data in accordance with the moved direction and distance of the mouse pointer 501, and then rewrites or updates the singing score data with the changed data. For example, if the user moves the mouse pointer 501 rightward a distance equal to 100 minimum time units while depressing the mouse button and then releases the mouse button, the data change section 208 adds a value "100" to the vibrato-period start time point of note N1003.

In changing the vibrato-period start time point as above, the data change section 208 limits a scope of the data change to prevent the vibrato period from exceeding the sounding period of the note data. For example, according to the singing score data, the sounding period of note N1003 is "904" while the vibrato period of note N1003 is "480". Thus, even when the user has greatly dragged the pictorial figure 604*a* rightward, the vibrato-period start time point of note N1003 can be reliably prevented from exceeding "424".

Further, by performing drag-and-drop operations of a left end portion of the pictorial figure 604*a*, the user can simultaneously change both the vibrato-period start time point and the vibrato-period time length without changing at all the vibrato-period end time point. Further, by performing drag-and-drop operations of a right end portion of the pictorial figure 604*a*, the user can simultaneously change the vibrato-period time length without changing at all the vibrato-period start time point. In these cases too, the vibrato period will be prevented from exceeding the sounding period of the note data.

The additional attribute data employed in the instant embodiment include, in addition to additional attribute data of a first type, such as vibrato-related data, for which an application period of a musical expression or the like is important, additional attribute data of a second type, such as volume change data, for which application timing of a musical expression or the like is important. Such a second type of additional attribute data is associated with timing-related time data instead of time-length-related time data. For such a second type of additional attribute data, the display section 204 displays, at a corresponding location of the screen, a pictorial figure or the like of which horizontal length has no meaning.

1.2.3. Display and Change of Singing Timing Data:

The score data editing section 20 can also display contents of singing timing data (FIG. 5) generated by the singing synthesis section 30. As already explained above, the singing timing data include, for each segment contained in a singing voice performed by the singing synthesis section 30, sounding-period-related data indicative of a "sounding-period start time point" and "adjusted segment time length".

The sounding period of each segment depends on the size of the segment data used in the singing performance. Segment data is selected by the data selection section 304 from the segment database 303 having stored therein, as a plurality of individualized databases, groups of segment data sampled from singing voice waveforms of a plurality of different singers as explained above in relation to FIG. 4.

Whichever one of the individualized databases given segment data may be selected from, the duration adjustment section 306 adjusts the time length of the selected segment data in such a manner that the sounding-period start time point of vowel segment data agrees with data pertaining to a sounding-period start time point included in the singing performance data. However, depending on the singer, a transient portion from a consonant, preceding the vowel segment data, to the vowel may have a prolonged time length and so a human listener may feel, from singing voices performed by the singing synthesis section 30, that the singing timing is faster, and vice versa.

If the user wants to ascertain the sounding period of each segment in the singing performance, the user instructs the score data editing section 20 to display singing timing data. The score data editing section 20 transmits, to the singing synthesis section 30 via the data output section 211, the singing score data along with a singing-timing-data transmission instruction.

Upon receipt of the singing timing data and singing-timing-data transmission instruction from the score data editing section 20, the singing synthesis section 30 generates singing timing data by performing the above-described process on the basis of the received singing score data. Then, the singing synthesis section 30 transmits the thus-generated singing timing data to the score editing section 20 via the data output section 311.

The score data editing section 20 received the singing timing data via the data input section 20 and stores the received singing timing data in the storage section 203. Then, on the basis of the singing timing data, the display section 20 displays, on a piano roll screen, a pictorial figure indicative of a sounding period of a voice represented by each segment data.

Figure 10:
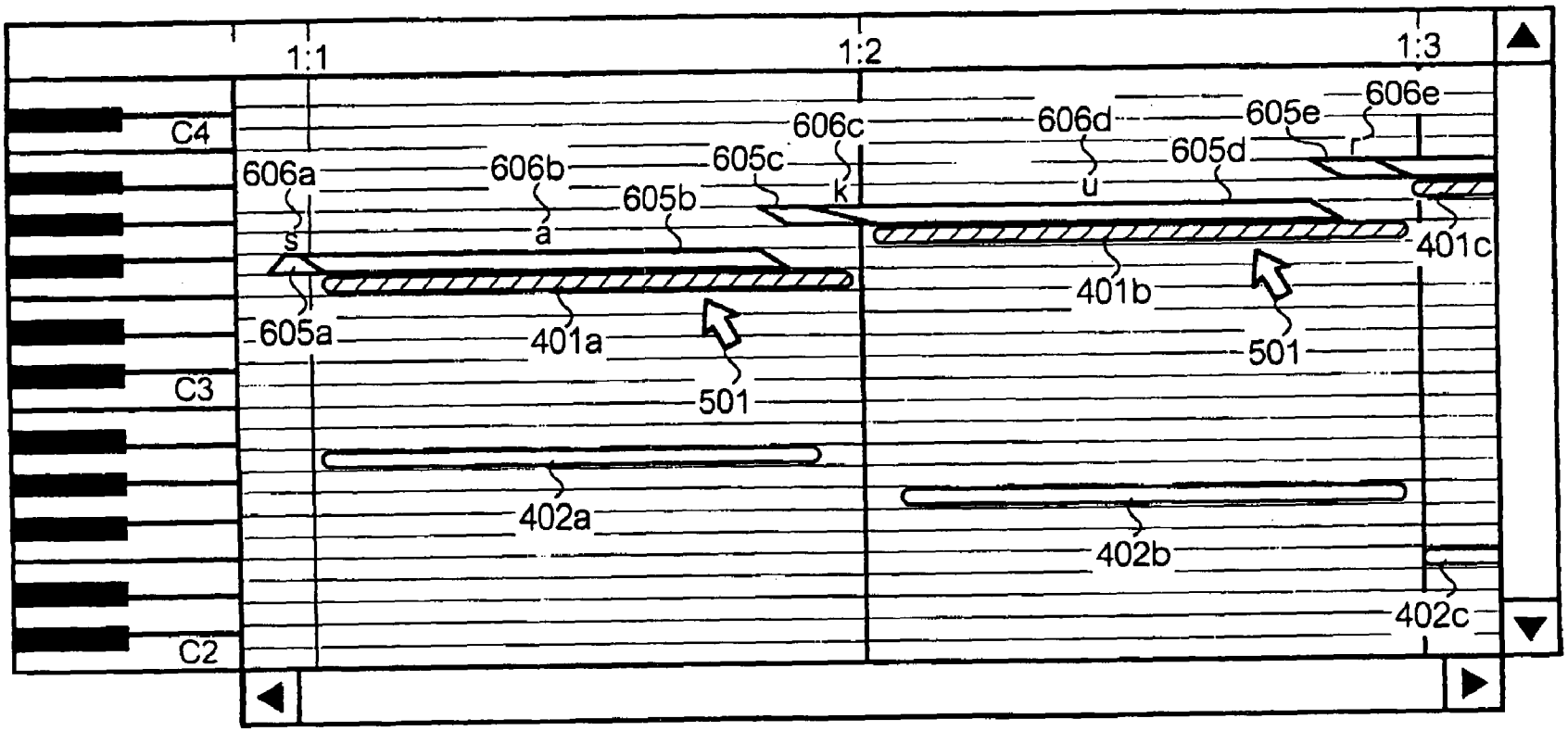
FIG. 10 shows another example of the piano roll screen displayed in the embodiment.

FIG. 10 shows an example of the piano roll screen showing the contents of the singing timing data. In the figure, a horizontal scale is increased as compared to that of FIG. 9 in such a manner that a same horizontal dimension represents one fourth a given time length in FIG. 9. Graphic symbols 605*a*–605*e* each represent segment data corresponding to phonetic symbols 606*a*–606*e* displayed immediately above the pictorial figures 605*a*–605*e*.

For example, the pictorial figure 605*a* represents three segment data "#s", "s" and "s-a" corresponding to the phonetic symbol "s" represented by 606*a*. Left and right end apexes of the pictorial figure 605*a* indicate start and end time points of a voice represented by the individual segment data. Namely, the left triangular portion of the pictorial figure 605*a* corresponds to segment data "#s", the middle rectangular portion of the symbol 605*a* corresponds to segment data "s", and the right triangular portion of the symbol 605*a* corresponds to segment data "s-a". Similar explanation applies to the other pictorial figures 605*b*–605*e*. Note that the right triangular portion of the pictorial figure 605*a* and the left triangular portion of the pictorial figure 605*b* both correspond to segment data "s-a".

The display section 204 identifies segment data corresponding to individual note data on the basis of phonetic symbol data in the singing score data. For example, for note N1001, whose phonetic symbol is "sa", the display section 204 identifies corresponding segment data "#s", "s", "s-a", "a" and "a-k". Further, the display section 204 determines horizontal display positions and sizes of the graphical symbols corresponding to the individual segment data, on the basis of the data of sounding-period start time points and adjusted element time lengths included in the singing timing data.

By operating on the pictorial figures 605*a*–605*e*, the user can change the data of sounding-period start time points and adjusted element time lengths in the singing timing data, in generally the same manner as in the above-described operation of the pictorial figure 604*a* representing a vibrato period. When some change has been made to the singing timing data through user operation on any one of the segment-data-corresponding pictorial figures on the piano roll screen, data related to the sounding period of the corresponding note data may be changed simultaneously with the singing timing data.

After having changed the singing score data as desired in the above-described manner, the user instructs execution of the singing performance. In accordance with the user's instruction, the score data editing section 20 transmits the singing score data to the singing synthesis section 30 via the data output section 211. Further, the singing timing data are stored in the storage section 203. If any change has been made to the singing timing data, the score data editing section 20 transmits the changed singing timing data, in place of the singing score data, to the singing synthesis section 30.

If the singing score data have been received from the score data editing section 20, the singing synthesis section 30 generates singing timing data and then singing voice data by performing the above-described processes, and then the singing synthesis section 30 executes a singing performance by reproducing the thus-generated singing voice data. If, on the other hand, the singing timing data have been received from the score data editing section 20, the singing synthesis section 30 generates singing voice data using the received singing timing data, and then the singing synthesis section 30 executes a singing performance by reproducing the thus-generated singing voice data.

With the construction and operation having been detailed above, the instant embodiment allows the user to visually grasp the sounding period of each segment by auditorily ascertaining the singing performance based on the singing score data and by viewing the display of the singing timing data. Therefore, as the user becomes familiar with the embodiment of the score data displaying/editing apparatus, the user is allowed to edit the singing-performance score data while visually grasping the singing performance to be executed on the basis of the singing score data.

2. Modification:

The above-described embodiment is only for purposes of illustration of the present invention and may be varied variously without departing from the basic principles of the present invention.

For example, the score data edited by the score data displaying/editing apparatus may be transmitted to a tone generator apparatus that is capable of outputting tones of a monophonic musical instrument, rather than to a singing synthesis apparatus. In such a case, however, no data related to a phonetic symbol is included in the score data, and the contents of the singing timing data are not visually displayed.

The score data may be of any suitable data format, such as one based on the MIDI (Musical Instrument Digital Interface) standard.

Whereas, in the above-described embodiment, the singing synthesis system is implemented by causing a general-purpose computer to perform various processes based on an application program, a similar singing synthesis system may be implemented by dedicated hardware. Further, in each of the cases where a general-purpose computer is used and where dedicated hardware is used, there is no need to place all components of the singing synthesis system in a single casing. For example, the components of the singing synthesis system may be provided separately from, and independently of, each other and connected with each other via a LAN or otherwise.

In summary, the score data displaying/editing apparatus and program of the present invention are characterized by displaying, for a plurality of note data, the contents of a plurality of types of additional attribute data, related to expressions included in the note data, in proximity pictorial figures indicative of pitches and sounding periods of the note data. As a result, the present invention allows the user to readily ascertaining the contents of a given one of the types of data for the plurality of note data, while grasping correspondency between the contents of the given type of data and the contents of the other types of data.

Further, the score data displaying/editing apparatus and program of the present invention are characterized by sequentially setting, for a plurality of note data, a selected type of data to a changeable state with the contents of a plurality of types of additional attribute data displayed in proximity to pictorial figures indicative of pitches and sounding periods of the note data. As a result, the present invention allows the user to readily change the contents of a given one of the types of data for the plurality of note data while grasping correspondency between the contents of the given type of data and the contents of the other types of data.

Furthermore, the score data displaying/editing apparatus and program of the present invention are characterized by displaying, for a sound represented by pitch- and sounding-period-related data included in the note data, a pictorial figure or the like indicative of additional attribute data, instructing impartment of an expression or the like, at a position and in a size corresponding to a period or timing when the additional attribute data is to be applied.

Furthermore, the score data displaying/editing apparatus and program of the present invention are characterized by displaying for singing score data used in a singing synthesis apparatus, a pictorial figure or the like indicative of pitch- and sounding-period-related data included in the score data, along with a pictorial figure or the like indicative of a sounding period of each phonetic characteristic portion of a voice waveform in a singing performance executed by the singing synthesis apparatus. As a result, the user is allowed to finely ascertain the sounding period of voices of a singing performance executed by the singing synthesis apparatus.

What is claimed is:

1. A score data displaying/editing apparatus comprising:

a storage section that stores score data including a plurality of note data, each of the note data including (a) fundamental attribute data composed of pitch data indicative of a pitch of a sound and sounding period data indicative of a sounding period of the sound, and (b) a plurality of types of additional attribute data indicative of attributes other than the pitch and sounding period of the sound;

a display section that, for each of the plurality of note data, displays a pictorial figure or symbol indicative of contents of the fundamental attribute data included in the note data and a letter, numeral, symbol or pictorial figure indicative of contents of the additional attribute data included in the note data, simultaneously in proximity to each other; and a selection section that selects one or more of the plurality of types of additional attribute data, and wherein said display section displays a letter, numeral, symbol or pictorial figure indicative of contents of the additional attribute data of the types selected by said selection section.

2. A score data displaying/editing apparatus comprising:

a storage section that stores score data including a plurality of note data, each of the note data including (a) fundamental attribute data composed of pitch data indicative of a pitch of a sound and sounding period data indicative of a sounding period of the sound, and (b) a plurality of types of additional attribute data indicative of attributes other than the pitch and sounding period of the sound;

a display section that, for each of the plurality of note data, displays a pictorial figure or symbol indicative of contents of the fundamental attribute data included in the note data and a letter, numeral, symbol or pictorial figure indicative of contents of the additional attribute data included in the note data, simultaneously in proximity to each other;

a state change section that sets, to a changeable state, one of the additional attribute data for each of which the letter, numeral, symbol or pictorial figure indicative of the contents is being displayed by said display section; and a data change section that changes the additional attribute data having been set to the changeable state by said state change section, or sets the additional attribute data, having been set to the changeable state, to a non-changeable state without changing the same, wherein the plurality of note data constituting the score data are segmented into a plurality of part data corresponding to a plurality of parts, and wherein said state change section selects one of the additional attribute data of one of the types, selected by said selection section, on the basis of at least one of the pitch data, sounding period data and additional attribute data included in the part data that include the one additional attribute data, and then said state change section sets the selected additional attribute data to a changeable state.

3. A score data displaying/editing apparatus as claimed in claim 2, wherein, when one of the additional attribute data is set to the non-changeable state by said data change section, said state change section sets the selected additional attribute data to a changeable state.

4. A score data displaying/editing apparatus as claimed in claim 2, wherein said display section displays pictorial figures or symbols indicative of the contents of the fundamental attribute data of the note data included in the part data that include the additional attribute data set by said state change section to the changeable state, in a different style from pictorial figures or symbols indicative of the contents of the fundamental attribute data of the note data included in the part data that do not include the additional attribute data set by said state change section to the changeable state.

5. A score data displaying/editing apparatus comprising:

a storage section that stores score data including a plurality of note data, each of the note data including (a) fundamental attribute data composed of pitch data indicative of a pitch of a sound and sounding period data indicative of a sounding period of the sound, and (b) a plurality of types of additional attribute data indicative of attributes other than the pitch and sounding period of the sound; and a display section that, for each of the plurality of note data, displays a pictorial figure or symbol indicative of contents of the fundamental attribute data included in the note data and a letter, numeral, symbol or pictorial figure indicative of contents of the additional attribute data included in the note data, simultaneously in proximity to each other, wherein the additional attribute data corresponds to any one of attributes of a phonetic symbol, note velocity, accent intensity, legato intensity, vibrato intensity and vibrato period.

6. A score data displaying/editing apparatus comprising:

a storage section that stores score data including a plurality of note data, each of the note data including (a) fundamental attribute data composed of pitch data indicative of a pitch of a sound and sounding period data indicative of a sounding period of the sound, (b) additional attribute data indicative of an attribute other than the pitch and sounding period of the sound, and (c) time data indicative of timing or period when control based on the additional attribute data is to be applied;

a display section that, for each of the plurality of note data, displays a pictorial figure or symbol indicative of contents of the fundamental attribute data included in the note data and a letter, numeral, symbol or pictorial figure indicative of contents of the additional attribute data included in the note data, simultaneously at a position specified on the basis of the time data included in the note; and a selection section that selects one or more of the plurality of types of additional attribute data, and wherein said display section displays a letter, numeral, symbol or pictorial figure indicative of contents of the additional attribute data of the types selected by said selection section.

7. A score data displaying/editing apparatus as claimed in claim 6, wherein, for each of the plurality of note data, said display section displays, on a coordinate plane having a first axis representative of a sound pitch and a second axis representative of passage of time and at a position, in a direction of said first axis, corresponding to the sound pitch indicated by the pitch data included in the note data, a pictorial figure having, as opposite end points thereof, positions, in a direction of said second axis, corresponding to start and end time points of the sounding period indicated by the sounding period data included in the note data.

8. A score data displaying/editing apparatus comprising:

a storage section that stores score data including a plurality of note data, each of the note data including (a) fundamental attribute data composed of pitch data indicative of a pitch of a sound and sounding period data indicative of a sounding period of the sound, (b) additional attribute data indicative of an attribute other than the pitch and sounding period of the sound, and (c) time data indicative of timing or period when control based on the additional attribute data is to be applied;

a display section that, for each of the plurality of note data, displays a pictorial figure or symbol indicative of contents of the fundamental attribute data included in the note data and a letter, numeral, symbol or pictorial figure indicative of contents of the additional attribute data included in the note data, simultaneously at a position specified on the basis of the time data included in the note data, wherein, for each of the plurality of note data, said display section displays, on a coordinate plane having a first axis representative of a sound pitch and a second axis representative of passage of time and at a position, in a direction of said first axis, corresponding to the sound pitch indicated by the pitch data included in the note data, a pictorial figure having, as opposite end points thereof, positions, in a direction of said second axis, corresponding to start and end time points of the sounding period indicated by the sounding period data included in the note data, and wherein said display section further displays a pointer in the form of a pictorial figure or symbol indicative of a position on the coordinate surface;

a position control section that controls the position of the pointer on the coordinate surface;

a designation section that, when a letter, numeral, symbol or pictorial figure indicative of the contents of the additional attribute data is being displayed, by said display section, at a position pointed to by the pointer, designates the letter, numeral, symbol or pictorial figure; and a data change section that changes the contents of the additional attribute data being displayed in the letter, numeral, symbol or pictorial figure designated by said designation section, in accordance with a variation in the position of the pointer made by said position control section.

9. A score data displaying/editing apparatus comprising:

a storage section that stores score data including a plurality of note data, each of the note data including (a) fundamental attribute data composed of pitch data indicative of a pitch of a sound and sounding period data indicative of a sounding period of the sound, (b) additional attribute data indicative of an attribute other than the pitch and sounding period of the sound, and (c) time data indicative of timing or period when control based on the additional attribute data is to be applied; and a display section that, for each of the plurality of note data, displays a pictorial figure or symbol indicative of contents of the fundamental attribute data included in the note data and a letter, numeral, symbol or pictorial figure indicative of contents of the additional attribute data included in the note data, simultaneously at a position specified on the basis of the time data included in the note data, wherein, for each of the plurality of note data, said storage section stores, as the additional attribute data, data indicative of a partial voice waveform obtained by dividing a voice waveform corresponding to a word of a song in accordance with a phonetic characteristic of the voice waveform.

10. A score data displaying/editing apparatus comprising:

a storage section that stores score data including a plurality of note data, each of the note data including (a) fundamental attribute data composed of pitch data indicative of a pitch of a sound and sounding period data indicative of a sounding period of the sound, (b) additional attribute data indicative of an attribute other than the pitch and sounding period of the sound, and (c) time data indicative of timing or period when control based on the additional attribute data is to be applied; and a display section that, for each of the plurality of note data, displays a pictorial figure or symbol indicative of contents of the fundamental attribute data included in the note data and a letter, numeral, symbol or pictorial figure indicative of contents of the additional attribute data included in the note data, simultaneously at a position specified on the basis of the time data included in the note data, wherein the additional attribute data corresponds to any one of attributes of a phonetic symbol, note velocity, accent intensity, legato intensity, vibrato intensity and vibrato period.

11. A computer-readable storage device storing a program for execution by a computer, said program including instructions for:

displaying score data including a plurality of note data, each of the note data including (a) fundamental attribute data composed of pitch data indicative of a pitch of a sound and sounding period data indicative of a sounding period of the sound, and (b) a plurality of types of additional attribute data indicative of attributes other than the pitch and sounding period of the sound;

for each of the plurality of note data, displaying a pictorial figure or symbol indicative of contents of the fundamental attribute data included in the note data and a letter, numeral, symbol or pictorial figure indicative of contents of the additional attribute data included in the note data, simultaneously in proximity to each other;

selecting one or more of the plurality of types of additional attribute data; and displaying a letter, numeral, symbol or pictorial figure indicative of contents of the additional attribute data of the types selected.

* * * * *